US009416600B2

(12) United States Patent
Golovinskij

(10) Patent No.: US 9,416,600 B2
(45) Date of Patent: Aug. 16, 2016

(54) CONDUCTOR PIPE SUPPORT SYSTEM FOR AN OFF-SHORE PLATFORM

(71) Applicant: Maersk Drilling A/S, Copenhagen K (DK)

(72) Inventor: Nikolaj Golovinskij, Charlottenlund (DK)

(73) Assignee: MAERSK DRILLING A/S, Copenhagen K (DK)

( * ) Notice: Subject to any disclaimer, the term of this patent is extended or adjusted under 35 U.S.C. 154(b) by 0 days.

(21) Appl. No.: 14/638,606

(22) Filed: Mar. 4, 2015

(65) Prior Publication Data

US 2015/0252634 A1 Sep. 10, 2015

(30) Foreign Application Priority Data

Mar. 4, 2014 (DK) ..... 2014 70106

(51) Int. Cl.

| | |
|---|---|
| ***E21B 19/00*** | (2006.01) |
| ***F16L 13/06*** | (2006.01) |
| ***E21B 7/12*** | (2006.01) |
| ***E21B 29/12*** | (2006.01) |
| ***E21B 19/24*** | (2006.01) |
| ***E02B 17/02*** | (2006.01) |
| *E02B 17/00* | (2006.01) |

(52) U.S. Cl.

CPC ..... *E21B 19/004* (2013.01); *E02B 17/021* (2013.01); *E21B 19/24* (2013.01); *E02B 2017/006* (2013.01); *E02B 2017/0073* (2013.01)

(58) Field of Classification Search

None

See application file for complete search history.

(56) References Cited

U.S. PATENT DOCUMENTS

| | | | | |
|---|---|---|---|---|
| 3,195,639 | A | 7/1965 | Pollard et al. | |
| 4,401,398 | A * | 8/1983 | Remson | E21B 7/136 166/367 |
| 4,480,819 | A * | 11/1984 | Lopez | E04G 21/3233 182/113 |
| 5,524,710 | A | 6/1996 | Shinn | |
| 6,045,296 | A | 4/2000 | Otten et al. | |
| 6,688,814 | B2 * | 2/2004 | Wetch | E21B 19/004 166/355 |
| 7,451,821 | B2 * | 11/2008 | Rashid | B63B 27/02 166/351 |

* cited by examiner

*Primary Examiner* — Matthew R Buck
*Assistant Examiner* — Douglas S Wood
(74) *Attorney, Agent, or Firm* — Buchanan Ingersoll & Rooney PC

(57) ABSTRACT

A conductor pipe support system for a bottom-supported offshore drilling rig, the conductor pipe support system including a guide member configured for supporting a conductor pipe against horizontal movement when the conductor pipe extends from a blow-out preventer downward towards the seabed; a support member configured for vertically supporting at least a part of the load of the conductor pipe; and an access platform for allowing personnel to access at least a bottom portion of the blow-out preventer system; wherein the support member is connectable to the conductor pipe below the access platform.

17 Claims, 8 Drawing Sheets

Fig. 6(A)
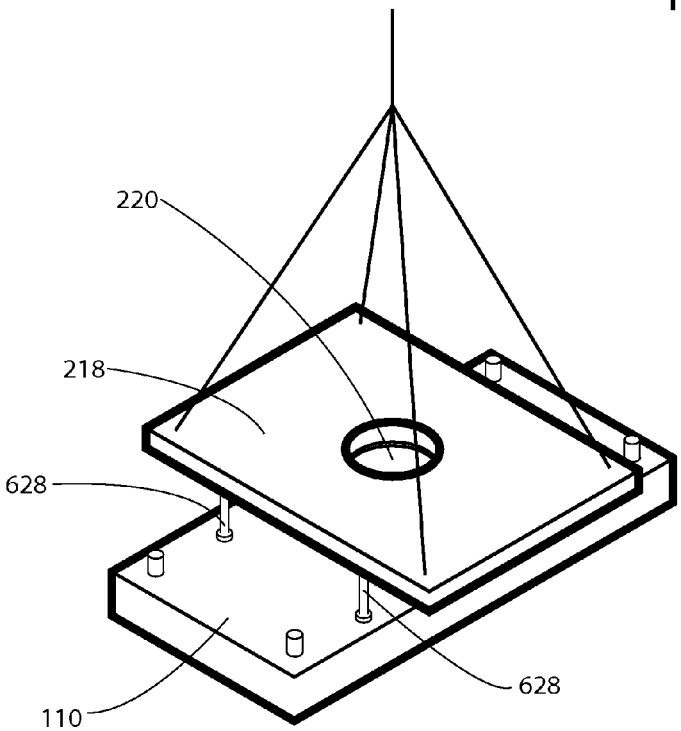
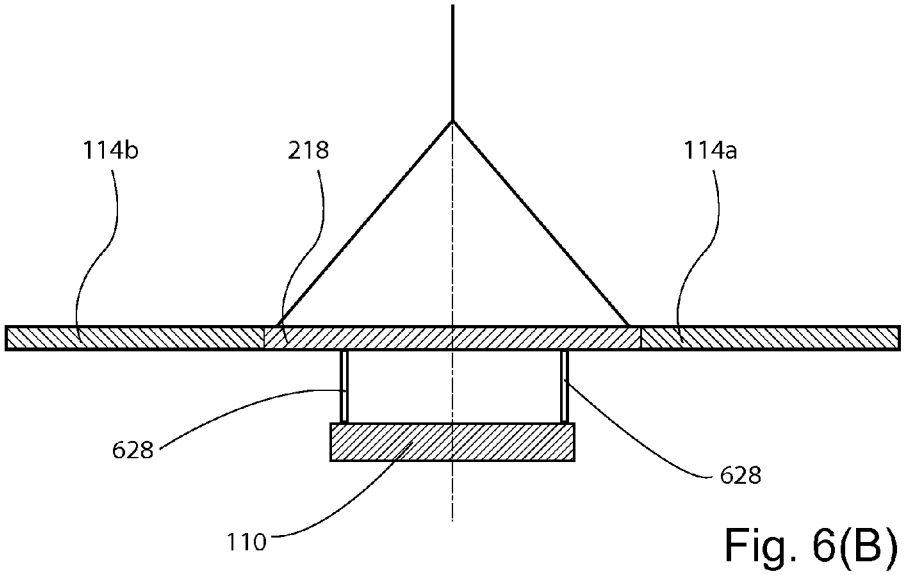
Fig. 6(B)

114b
220
218
114a 841
114b
110
218
114a 842
110
114b
220
218
114a 843
114b
220
218
114a 843
842
114b
110
218
114a 111
843
114b
110
218
114a

CONDUCTOR PIPE SUPPORT SYSTEM FOR AN OFF-SHORE PLATFORM

TECHNICAL FIELD

The invention generally relates to off-shore platforms, often also referred to as off-shore units or rigs. More particular, the invention relates to a conductor pipe support system for providing vertical and horizontal support to a conductor pipe extending from the off-shore rig towards the seafloor.

BACKGROUND

Off-shore drilling rigs are widely used in the exploration and exploitation of hydrocarbon reservoirs under the sea floor.

The various types of off-shore drilling units include the so-call bottom-supported rigs which rest on the seafloor. Jack-up rigs are typical examples of bottom-supported rigs; they typically comprise a hull and a number of legs adapted to be lowered towards the sea floor. Such rigs may thus be towed towards their desired off-shore location with the legs in a raised position. Once the rig is at its intended position the legs are lowered and brought into contact with the sea floor. Further lowering of the legs relative to the hull causes the hull to be elevated out of the water. Many jack-up rigs have the drill floor and well centre positioned on a cantilever system that can be extended horizontally outwards relative to the hull of the rig, thus allowing the well centre to be positioned outside the periphery of the unit defined by the hull of the rig.

On an offshore bottom-supported drilling rig, at least some drilling operations are performed through a conductor pipe. The conductor pipe comprises a string of pipe installed between a position below the drill floor of a bottom-supported drilling unit, such as a jack-up rig, and the hole in the seabed. It serves as a conduit for drilling tools and the returning drilling fluid such as mud. The conductor pipe is also referred to as a riser, such as a high-pressure riser or a drive pipe or other type of riser.

To this end, a bottom-supported drilling rig comprises a blow-out-preventer (BOP) system installed below the drill floor but above the water level, and the conductor pipe extends from the BOP downwards towards the seabed. The BOP is normally arranged in a vertical tier referred to as BOP stack and installed to control downhole pressures. The conductor pipe may thus serve as a base for the BOP stack which is installed above it.

An offshore drilling rig normally comprises an access platform below the well centre and the drill floor so as to allow workers access the BOP stack. The access platform is also referred to as the Texas deck and it typically surrounds the base of the BOP stack and is suspended from the cantilever (e.g. by adjustable cables or rods) or attached to a side wall of the hull. It may e.g. be accessed from the hull of the rig by a semi-permanent stairwell.

One known type of Texas deck comprises a drive pipe support member for supporting the conductor pipe against horizontal movement. This type of Texas deck is typically attached to the hull of the rig and is also referred to as drive pipe support deck.

Bottom-supported rigs typically also comprise a tensioner system for providing vertical support to and tension in the conductor pipe also referred to as tension load. For example, the tensioner system may comprise hydraulic cylinders extending downward from the cantilever, and a tensioning frame suspended from the cylinders such that the conductor pipe is suspended in and held under tension by the tensioning frame. The tensioning frame is often also referred to as tensioning yoke. In some embodiment the tensioner system is also arranged to provide vertical (horizontal) support as well.

In many situations it may be desirable to install additional equipment below the cantilever and above the Texas deck, such as additional BOP rams, pressure control/management equipment, and/or the like. However, the available height between the Texas deck and the bottom of the cantilever may limit the space available for installation of such equipment. In particular this may be a problem in situations where the Texas deck is attached to the hull which may prevent the Texas deck from being installed further below the cantilever.

It would thus be desirable to provide a drilling rig where additional and/or larger equipment may be installed below the cantilever.

Riser tensioning systems are generally also known from other types of oil and gas platforms, such as floatable platforms. For example, U.S. Pat. No. 5,524,710 discloses an oilfield hanger and wellhead system and, more particularly, a hanger assembly for suspending a tubular string in tension from a surface wellhead on an offshore tension leg platform which floats on the water surface. In this prior art platform the BOP stack is mounted on a surface wellhead which is positioned on the rig base.

U.S. Pat. No. 3,195,639 describes a floating barge from which the riser and BOP are suspended below the surface of the water. For maintenance or repair, the BOP has to be raised to the barge.

U.S. Pat. No. 6,045,296 discloses a tensioning device for applying tension to a riser from a surface deck. A so-called Christmas tree or surface well head is shown above the surface deck from which tension is applied to the riser.

However, the above prior art systems are not directly applicable to a cantilevered bottom-supported rig where the blow-out preventer system is positioned below a cantilever and above the water surface.

SUMMARY

According to a first aspect, disclosed herein are embodiments of a bottom-supported offshore drilling platform comprising:

a hull and one or more legs extendable from the hull downward towards the seabed of a body of water so as to elevate the hull above a surface of the body of water;

a cantilever comprising a drill floor and a well centre defined in the drill floor though which well centre drilling operations may be performed through a blow-out-preventer system located below the cantilever and through a conductor pipe extending from the blow-out-preventing system downwards towards the seabed;

a conductor pipe support system comprising:

a guide member configured for supporting the conductor pipe against horizontal movement when the conductor pipe extends from the blow-out preventer system downward towards the seabed;

a support member configured for vertically supporting at least a part of the load of the conductor pipe; and an access platform for allowing personnel to access at least a bottom portion of the blow-out preventer system;

wherein the support member is connectable to the conductor pipe below the access platform.

Consequently, as the support member is installed below the access platform, space is freed up above the platform for other equipment to be installed above the platform. Moreover, the inventor has realised that an efficient installation of the support system is possible when the support member is installed below the access platform. Moreover easy access to the blow-out-preventer system and/or other equipment from the access platform is provided. The blow-out preventer system may comprise a vertical tier of two or more blow-out preventer devices, also referred to as BOP stack.

The guide member and the access platform are typically positioned below the BOP stack. In some embodiments, the guide member is connected to, or even integrated into the access platform. In particular, in some embodiments, the access platform defines a gap through which the conductor pipe can project downwards, the gap having a periphery defined by the access platform; and the guide member spans across the gap and is connected to the access platform on respective sides of the gap. For example, the access platform may be fork-shaped comprising two platform sections extending horizontally away from the hull and forming said gap between them. The guide member may thus also be referred to as a centre section or drive pipe support centre section. The guide member may be formed as a plate having a through hole through which the conductor pipe can extend downwards. As the guide member is horizontally fixed relative to the drill floor, the conductor pipe is horizontally held in place by the guide member. To this end, the conductor pipe may be mounted with its hole aligned with the well centre.

Alternatively the guide member may be connected to the access platform and/or another part of the rig, such as the hull or the cantilever, in another suitable way to prevent horizontal displacement of the conductor pipe. To this end, the guide member may be located above the access platform, below the access platform or at the same level as the access platform.

The access platform may be attached at—or close to—a bottom portion of the hull or otherwise be arranged at a vertical position close to or even at the bottom of the hull so as to provide as much vertical distance between the cantilever and the access platform as practical. For example, the hull may comprise a side wall extending downwards from a deck level of a deck on which the cantilever is movably arranged. The side wall may be substantially vertical. The access platform may extend from—or otherwise be arranged at a vertical position of—the lower half, such as the lowest 25%, such as the lowest 10% of the side wall of the hull. Generally, during drilling operations, as the hull is elevated above the surface of the water, the access platform, the blow-out preventer system and the guide member are located above the surface of the water and underneath the cantilever.

In some embodiments, the access platform, or at least a part thereof, may be arranged such that it can be moved horizontally along the hull, e.g. by means of a skid arrangement, rails etc. In some embodiments, the access platform, or the part thereof, may be arranged to be moved sideways while a load is positioned on the access platform, e.g. a load larger than 30 t. Consequently, equipment may be lowered onto the access platform by a crane and be moved sideways underneath the cantilever. In some embodiments, the access platform may be hinged such that it can be pivoted during transit and/or when the cantilever is retracted such that it does not extend substantially beyond the periphery of the hull.

In some embodiments, the guide member is a component separate from the support member; in particular, the guide member may be configured to prevent horizontal movement without limiting vertical motion of the conductor pipe. In alternative embodiments, the guide member and the support member may be connected to each other or even provided as a combined component supporting the conductor pipe in both horizontal and vertical direction.

As mentioned above, the support member is configured for vertically supporting at least a part of the load of the conductor pipe and often also of the BOP resting on top of the conductor. To this end the support member may connect to the conductor pipe in many ways such as defining an opening through which the conductor pipe extends combined with a structure for engaging with the conductor pipe such as wedges, slips or the like, e.g. of a type similar to those structures applied in a rotary table or an annular or ram-type engagement structure similar those found in a BOP where they are designed to engage with drill pipe and/or casing. In some embodiments, the support member defines an opening through which the conductor pipe extends. The support member defines an upwardly facing support surface to which a flange that circumferentially extends around the conductor pipe may abut from above so as to allow the conductor pipe to rest in the support member. To this end, the support member may comprise an annular member surrounding the opening. The support member may have the form of a frame extending around the circumference of conductor pipe and radially extending away from the conductor pipe. The frame may be in the form of a horizontal plate or similar generally flat structure. Alternatively, the frame may be ring-shaped or have another suitable shape.

The support member has a plurality of connectors for connecting suspension elements such as wires, chains, cylinders, rods, etc., or combinations thereof. The connectors define respective suspension points of the support member, e.g. located along an outer periphery of the frame of the support member. The support member is thus connected to one end of each suspension element while the respective other ends of the suspension elements are connected to the rig, such as to the cantilever or similar fixed structure, typically below the drill floor and typically above the downward surface of the hull of the drilling platform, e.g. via tension cylinders extending downward from the cantilever structure. The support member is thus suspended underneath the cantilever such that the suspension elements transfer at least a major part of a conductor tension load—such as more than 70%, such as more than 80%, such as more than 90% of the conductor tension load—of the conductor pipe to the cantilever structure via respective load transfer points arranged above the access platform. Consequently, the conductor pipe resting in the support member may be vertically supported by the suspended support member and held under tension. Often, the support member is also referred to as tensioning frame. The load transfer points are intended to refer to the points where the major part of the vertical conductor tension load is transferred from the wires, cylinders, rods, chains or other suspension elements to the fixed structure of the cantilever. The load transfer points are typically defined by respective hooks, pulleys, shackle mounts, padeyes, or the like. The load transfer points may be positioned above the guide member, i.e. the guide member may vertically be located between a lower end of the suspension elements and an upper end of the suspension elements. Alternatively or additionally, the load transfer points may be positioned at a level above the blow-out preventer system or a least above a centre of mass of the blow-out preventer system or otherwise such that the blow-out preventer system extends downwards below the load transfer points. At least a major part of the weight of the blow-out preventer system is thus also suspended from the cantilever by means of the support member and the suspension elements.

In some embodiments, the suspension points are spaced apart by a distance smaller than a corresponding width of the gap defined by the access platform so as to allow the wires or other suspension elements to extend upwards from the suspension points through the gap defined by the access platform.

The suspension points may further form two groups each of one or more suspension points which are spaced apart from each other along at least one direction, e.g. the direction away from the hull along elongated platform sections, by a distance larger than a horizontal size of the guide member so as to allow the suspension elements to pass on respective sides of the guide member. The guide member may comprise slots or other openings through which the suspension elements may extend; in which case a distance between the slots may define the horizontal size of the guide member. In alternative embodiments, the access platform may comprise slots or other openings for the suspension elements.

When the support member is sized and shaped so as to allow it to be lowered through the gap in the access platform, the support member may efficiently be installed with the access platform being in place.

In another aspect, or in combination with the other aspects, the conductor pipe support system comprises

- a guide member configured for supporting the conductor pipe against horizontal movement when the conductor pipe extends from the blow-out preventer system downward towards the seabed;
- a support member configured for vertically supporting at least a part of the load of the conductor pipe;
- an access platform for allowing personnel to access at least a bottom portion of the blow-out preventer system; and
- an upper support for the blow-out preventer system arranged to provide horizontal support to the upper half of the blow-out preventer system, such as the upper third or the blow-out preventer system, such as the upper ¼ of the blow-out preventer system, such as the upper 10% of the blow-out preventer system.

Such a support system is beneficial for supporting a blow-out preventer system when it is not attached to the diverter of the drilling rig or otherwise supported at the top by the rig. This may be particularly advantageous with blow-out preventer systems of extensive length, heavy components or otherwise a high centre of gravity. The upper support is different from the diverter system. In some embodiments the upper support is formed by chains attached to attachment points on the rig/cantilever and attached to BOP stack, e.g. via a tension ring around a component or joint in the stack.

The cantilever may further comprise a hoisting system supported by a drilling support structure, such as a mast or derrick, extending upwards from the cantilever. The hoisting system is configured to raise and lower tubulars through the well centre and from/to the seabed. The drilling rig may further comprise a topdrive or other device operable to rotate the tubulars that are lowered or raised through the well centre.

In some embodiments the cantilever may comprise a cantilever base structure and a drill floor structure which is movably arranged relative to the cantilever base structure. The drill floor structure may comprise the drilling support structure and the drill floor defining the well centre. For example, the cantilever base structure may be movable relative to the hull in a first horizontal direction outwards relative to the hull while the drill floor structure may be horizontally movable along a second direction across, e.g. normal to, the first direction. Hence, the well centre may horizontally be positioned in two-dimensions within an area outside of the periphery of the hull by moving the cantilever base structure relative to the hull and/or the drill floor structure relative to the cantilever base structure. The support member may be suspended from the cantilever base structure or from the drill floor structure. Alternatively, a two-dimensional positioning of the well centre outside the periphery of the hull may be achieved by providing a cantilever that is movable along the first and the second directions relative to the hull and/or extendable along the first direction and pivotable around a point on the deck to reach positions along the first and second directions. In such cases the drill floor is then typically stationary arranged on the cantilever. The movement of the cantilever base structure and/or the drill floor structure may be performed by respective skidding arrangements.

The drilling platform may comprise one or more of the following devices installed below the drill floor and above the access platform: a diverter system; a BOP stack, a device for managed pressure drilling, e.g. a pressure control device, a wellhead device. The BOP stack may comprise at least two BOP rams, such as at least three BOP rams. At least two of the BOP rams may be separated by a quick connector device, such as an NT-2 connector. The BOP may further comprise an annular BOP component. The device for managed pressure drilling may be located above the BOP and below the diverter system. Generally, a device for managed pressure drilling (a pressure management device) refers to a device configured for controlling the pressure in the wellbore and, in particular, in the annulus by applying back pressure in the return mud flow. Examples of such devices include a Riser drilling device (RRD), a Pressure Control Device (PCD) and a Rotating Control Devices (RCD). Embodiments of such devices may be used in an adaptive drilling process used to control the annular pressure profile throughout the wellbore, e.g. so as to ascertain the downhole pressure environment limits and to manage the annular hydraulic pressure profile accordingly.

The present disclosure relates to different aspects including the bottom-supported offshore drilling platform described above and in the following, corresponding methods, devices, and/or product means, each yielding one or more of the benefits and advantages described in connection with the first mentioned aspect, and each having one or more embodiments with all or just the additional features corresponding to the embodiments described in connection with the first mentioned aspect and/or disclosed in the appended claims.

In particular, according to one aspect, disclosed herein are embodiments of a support member configured for supporting at least a part of the load of a conductor pipe when the conductor pipe extends from a blow-out preventer located below a bottom-supported offshore drilling platform downward towards the seabed, such as below the drill floor of a cantilever on a jack-up rig; wherein the support member defines an upper surface and has a hole through which the conductor pipe may extend downwards; and wherein the support member comprises a hand rail extending along a perimeter of said upper surface. Consequently, workers may safely access the upper surface of the support member, e.g. when installing the support member below another access platform. In some embodiments, the support member is a plate-shaped frame defining the upper surface and having said hole.

Generally, a support member may be configured to provide a tension of at least 100 t, such as at least 200 t such as at least 300 t.

According to yet another aspect, disclosed herein are embodiments of a method of installing a conductor pipe support system for a bottom-supported offshore drilling platform comprising a conductor pipe support system as described herein; wherein the method comprises connecting the support member to the conductor pipe below the access platform.

In some embodiments, the method comprises attaching the guide member to the access platform while the support member is suspended below the guide member. The support member may be suspended from the guide member, from the access platform, e.g. from respective beams spanning across a gap form in the access platform, from a drill pipe held by the hoisting system such as by a topdrive, or from a crane of the drilling rig.

The guide member and/or the support member may be suspended at its mounting position by the hoisting system of the drilling rig or by a BOP crane after the cantilever has slid out. Alternatively, the guide member and/or the support member may be suspended at its mounting position by an on-deck crane prior to sliding out the cantilever.

In some embodiments, the method further comprises installing the blow-out-preventing system and pressure management equipment between the access platform and the drill floor. In particular, the pressure management equipment may be installed above a BOP stack. The BOP stack and the pressure management device may be assembled component by component from bottom to top on top of the conductor pipe. It will be appreciated that all or parts of the BOP stack may be pre-assembled, e.g. inside a suitable rack or frame and installed as a preassembled assembly.

Generally, it is an advantage of embodiments of the system and method described herein that installation of the conductor pipe support system only requires limited modifications to existing drilling rigs (often comprising an existing BOP, e.g. a pre-assembled BOP stack), i.e. they may be installed as an upgrade or modification of existing rigs at relatively limited costs, e.g. when upgrading an existing drilling rig with pressure management equipment for managed pressure drilling and/or with extra rams or annular to work as a supplement or in combination with the existing BOP.

BRIEF DESCRIPTION OF THE DRAWINGS

The above and/or additional objects, features and advantages of embodiments and aspects of the present invention, will be further elucidated by the following illustrative and non-limiting detailed description with reference to the appended drawings, wherein:

FIGS. 5(A)-5(D), FIG. 6(A), FIG. 6(B), and FIGS. 8(A)-8(F) illustrate different embodiments of a method for installing a conductor pipe support system.

DETAILED DESCRIPTION

In the following description, reference is made to the accompanying figures, which show by way of illustration how the invention may be practiced.

Figure 1:
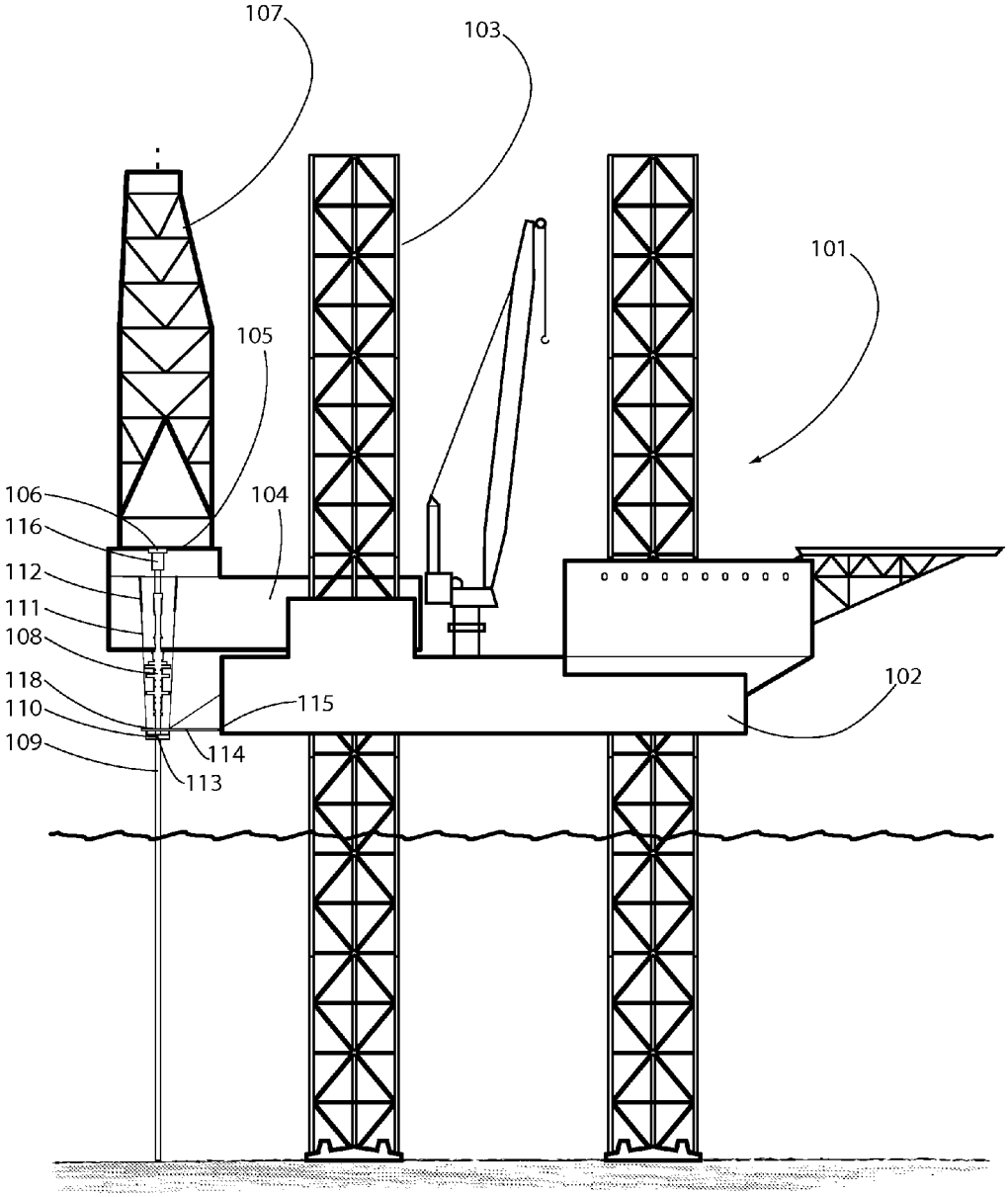
FIG. 1 schematically illustrates an example of a jack-up drilling rig.
Figure 2:
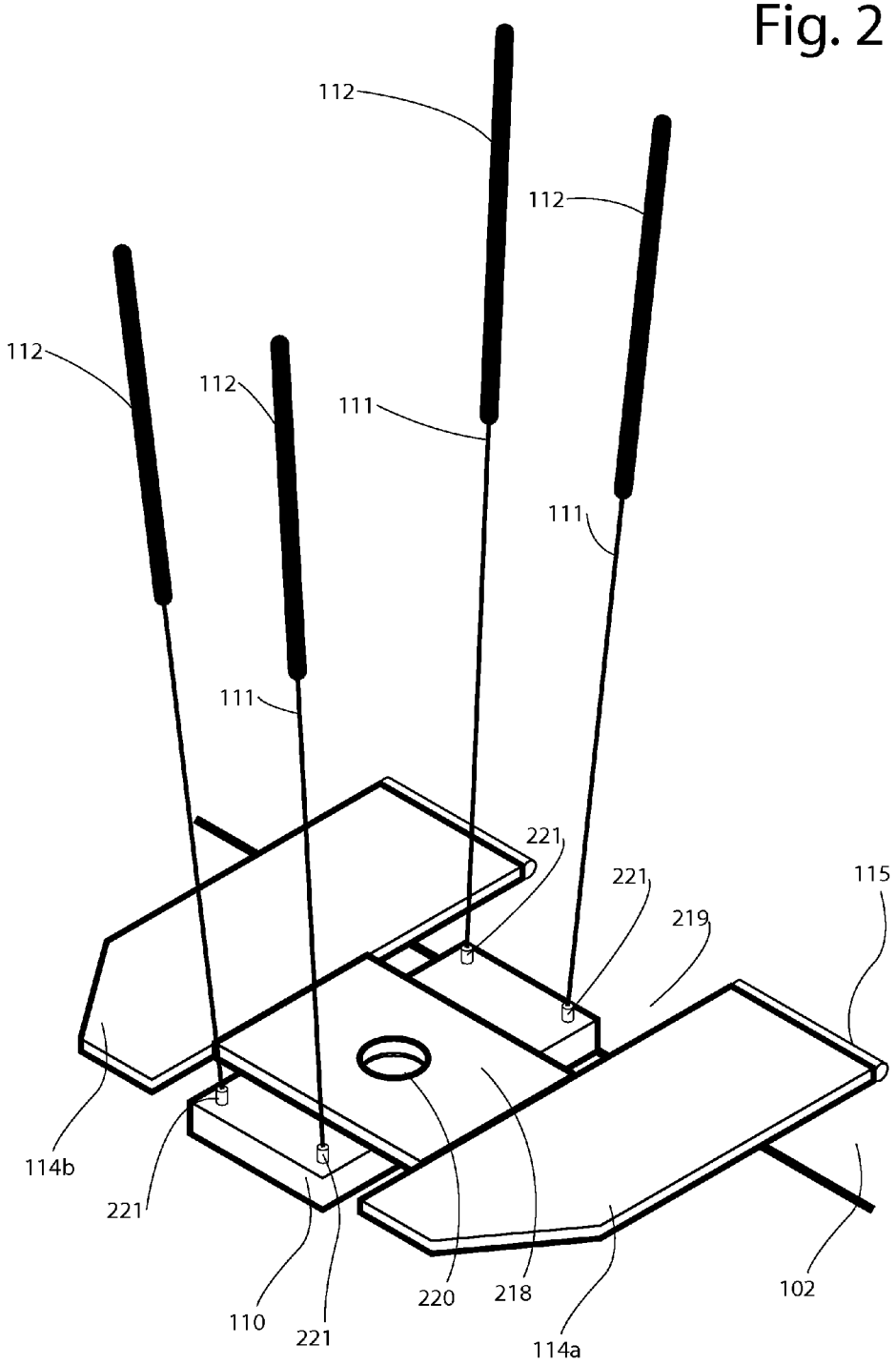
FIG. 2 illustrates an example of a conductor pipe support system.

FIG. 1 shows a side view of a jack-up drilling rig 101 while FIG. 2 shows an enlarge view of a portion of the rig. The jack-up rig includes a floatable platform having a hull 102, a number of legs 103 and a cantilever 104 which allows drilling equipment to be skidded so that the position of the well centre 105 can be moved horizontally. In particular, the cantilever 104 can be skidded such that it extends horizontally outside the periphery of the hull. The legs 103 are in this embodiment placed substantially in each corner of the rig and extend through the hull. The cantilever comprises the drill floor 105 from which drilling operations are conducted. A hole in the drill floor, typically in the form of a rotary table 106, defines the well centre though which drilling operations can be performed. Typically, a diverter system 116 is installed below the rotary table for closing the vertical passage through the pipes and for directing the flow of well fluids away from the drill floor. The drilling rig further comprises a drilling support structure 107, such as a mast or derrick, which extends upwardly from the cantilever and which supports a hoisting system. The hoisting system comprises a hook or similar device from which a string of tubulars may be suspended and lowered and raised through the well centre. To this end, the hoisting system may comprise a topdrive to which an upper end of the drill string may be connected and which may impart torque on the drill string.

The drilling rig is configured to perform drilling operations through a BOP stack 108 installed below the cantilever and through a conductor pipe 109 extending from the BOP stack downwards towards the seabed.

The drilling rig further comprises a conductor pipe support system which supports the weight of the conductor pipe 109 and which horizontally guides the conductor pipe so as to prevent horizontal displacement. To this end, the conductor pipe support system comprises support member in the form of a tension frame 110 or similar support member for vertically supporting the weight of the conductor pipe and a conductor pipe guide member 118. The load of the conductor pipe is supported by the tension frame 110 which is suspended below the cantilever, e.g. by wires 111 and/or cylinders 112 extending from the cantilever downwards to the tension frame. The tension frame comprises a through hole 113 through which the conductor pipe extends.

The drilling rig further comprises an access platform 114, also referred to as a Texas deck, arranged below the BOP stack which provides access to the BOP e.g. during installation and/or for maintenance. In this example, the access platform is at its one end attached to the hull 102 and it extends horizontally outward away from the hull. The access platform may be attached to the hull by hinges 115 such that the platform may be lifted into an upright position e.g. during transfer of the rig. Alternatively or additionally, the access platform may be suspended from the cantilever, e.g. by lines and/or cylinders. The BOP stack 108 may comprise multiple BOP rams and/or other components arranged in a vertical tier. Furthermore, additional equipment, such as pressure control equipment, may be installed above and/or below the BOP stack and below the rotary table and diverter system. The conductor pipe guide 118 is attached to the access platform 114, as will be described in greater detail below.

Figure 3:
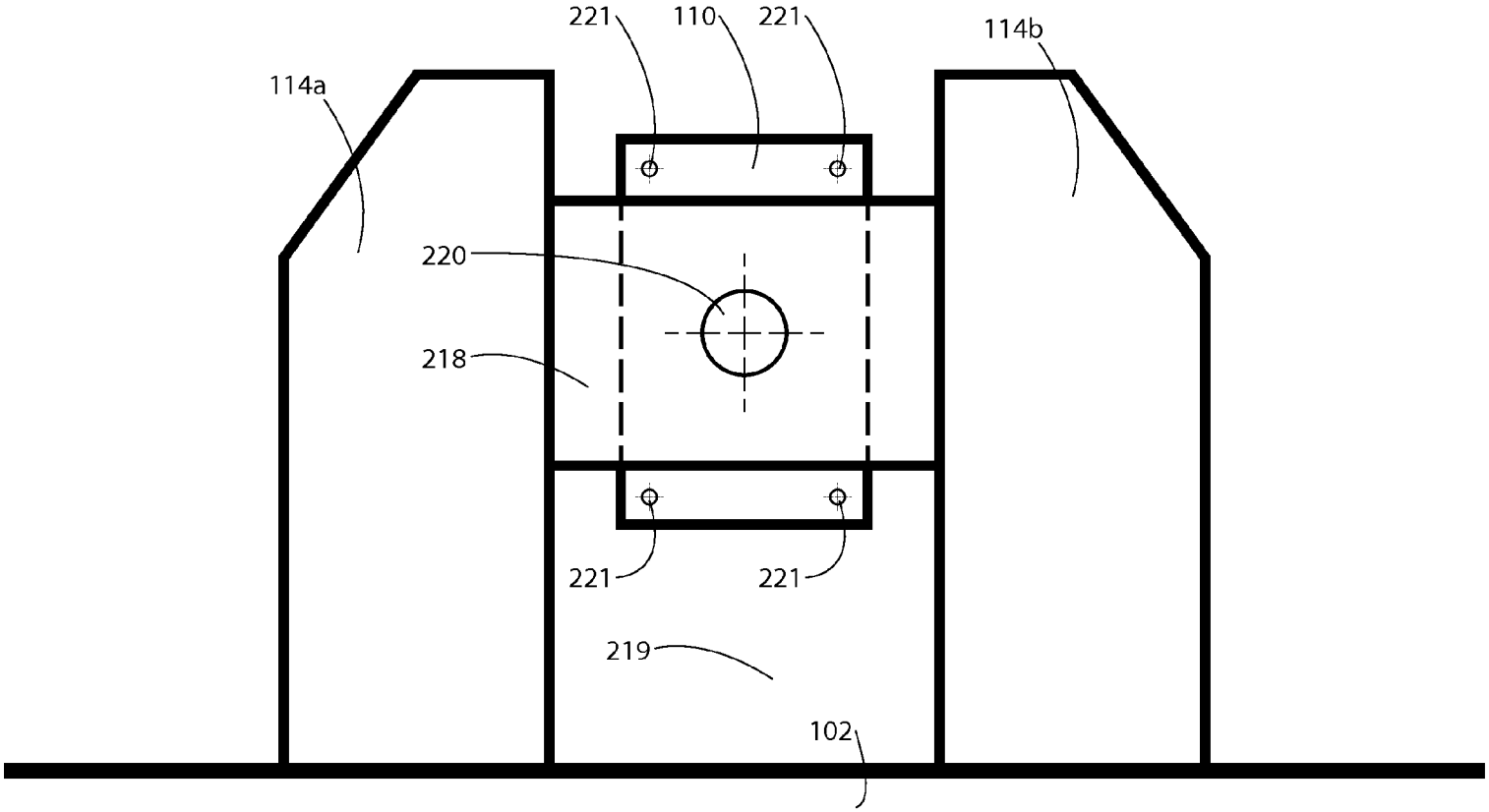
FIG. 3 shows a top view of a conductor pipe support system.
Figure 4:
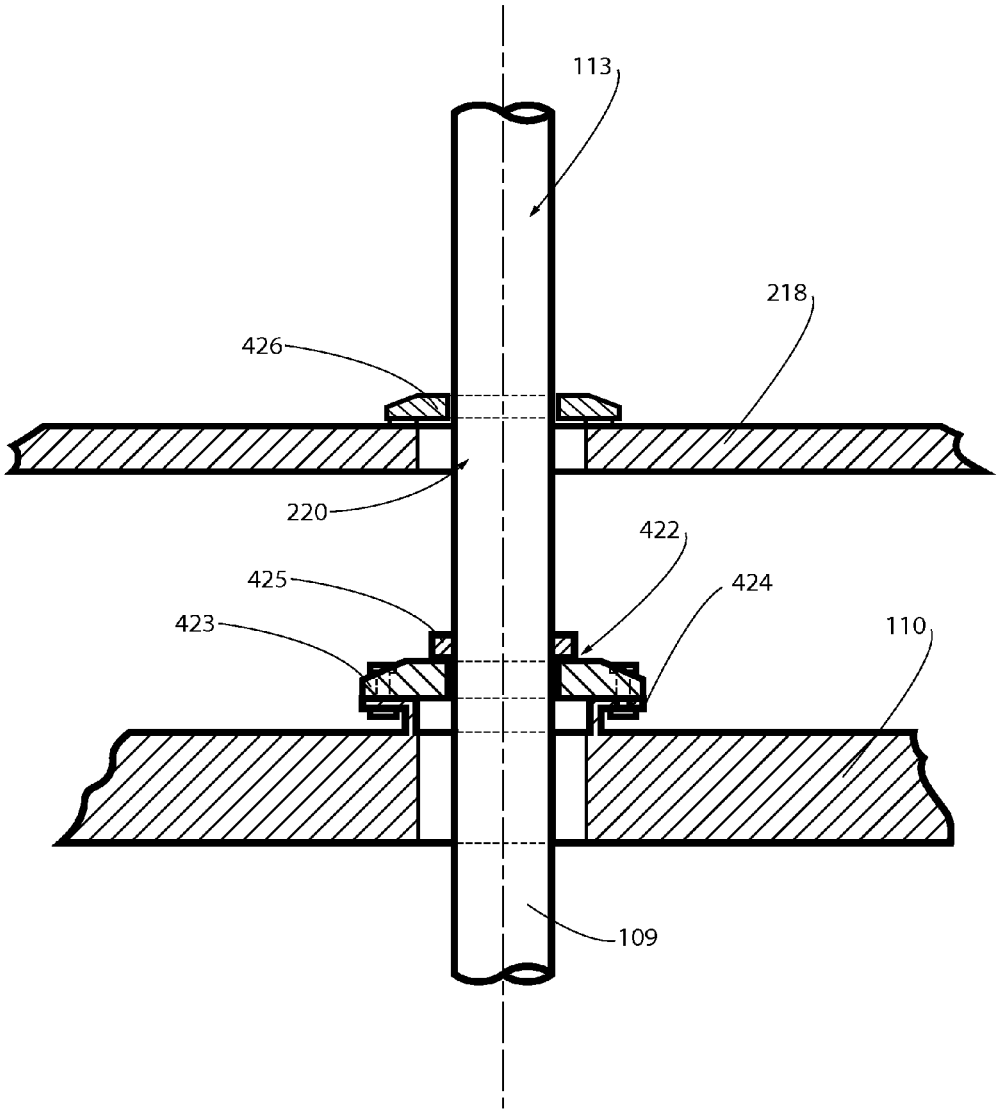
FIG. 4 shows a cross sectional view of a part of a conductor pipe support system.

An example of a conductor pipe support system will now be described with reference to FIGS. 2-4 where FIG. 2 shows a three-dimensional view of the conductor pipe support system, FIG. 3 shows a top view of the conductor pipe support system, and FIG. 4 shows a cross sectional view of a part of the conductor pipe suspension system. The conductor pipe support system is for use on a bottom-supported drilling rig such as a jack-up rig, e.g. the jack-up rig shown in FIG. 1.

In particular, FIG. 2 schematically shows an access platform 114*a,b* attached to the hull 102 of the drilling rig by hinges 115 and horizontally extending outwardly away from the hull. The access platform comprises two platform sections 114*a* and 114*b*, respectively, both extending away from the hull as parallel fingers in a fork-like fashion. The platform sections are laterally spaced apart from each other so as to form a gap 219 or slot between the platform sections. The gap has a length in the direction away from the hull and a width in the direction along the hull. While the platform sections 114*a,b* of the example of FIG. 2 are separated by the gap 219 along the entire length of the platform sections, it will be appreciated that the platform sections may be connected with each other by one or more bridge sections. The conductor pipe support system comprises a guide member arranged to guide the conductor pipe and formed as a centre section 218 extending across the width of the gap and attached, e.g. bolted, at each end to the respective platform sections 114*a,b*. The centre section 218 is formed as a plate, in this example a rectangular plate, which forms a central guide hole 220 through which the conductor pipe extends downward. The plate has a length in the direction away from the hull and a width in the direction along the hull, i.e. the direction connecting the platform sections.

The conductor pipe support system further comprises a support device which supports the vertical load of the conductor pipe 109. The support device comprises a tension frame 110 (also referred to as a tension yoke) or similar support member which is configured to surround the conductor pipe and which is suspended from the cantilever by suspension wires 111 and cylinders 112. The tension frame 110 is formed as a plate, e.g. a rectangular plate, having a through hole 113 through which the conductor pipe may extend downward. The tension frame comprises connectors 221 for attaching lifting wires at a number of lifting points, in this example positioned at the respective corners of the rectangular plate. The wires 111 are connected to the connectors and the respective other ends of the wires are connected to respective cylinders 112 whose other ends are, in turn, attached to the cantilever so as to allow the tension frame to be suspended below the cantilever.

As is illustrated in FIG. 2, the tension frame 110 is positioned below the centre section 218 with their respective through holes aligned with the well centre and with the wires 111 extending through the gap 219 between the platform sections. To this end, the connectors 221 are spaced apart in the direction along the hull by a distance that is smaller than the width of the gap. Similarly, the connectors 221 are spaced apart in the direction away from the hull by a distance that is larger than a smallest extent of the centre section 218 in the direction away from the hull. The smallest extent may be defined between the edges of the centre section spanning the gap 219. In some embodiments, the centre plate and/or Texas deck may comprise slots through which the wires may extend; in such an embodiment, the smallest extent is thus defined by the distance between slits at opposite edges of the centre section.

In the example of FIG. 2, the tension frame is formed as a rectangular plate having a length (in the direction away from the hull) longer than a smallest length of the centre section 218 and smaller than the length of the gap 219. The tension frame has a width smaller than the width of the gap 219, thus allowing the tension frame to be lowered through the gap and suspended by wires extending on either side of the centre section and extending through the gap 219.

As can most easily be seen in FIG. 4, the tension frame 110 comprises an annular support surface 422 surrounding the hole 113. For example, the support surface may be provided by a ring-shaped member 423 attached to a flange 424 on the upper surface of the tension frame, thus allowing the diameter of the hole to be easily adapted to different sizes of conductor pipes. The conductor pipe 109 comprises a corresponding flange 425 configured to rest on the support surface 422. While the ring-shaped member 423 of FIG. 4 is shown attached to a flange 424, it may be attached to the tension frame in another way. In alternative embodiments the ring-shaped member may merely rest—e.g. slidably rest—on the upper surface of the tension frame. It will further be appreciated that the ring-shaped member may be formed by multiple segments, e.g. by two half-moon sections. The tension frame may further be equipped with a hand-rail extending around a periphery of the upper surface of the tension frame so as to allow easy access during installation e.g. via a ladder from the access platform.

The centre section 218 providing the horizontal support may also be provided with a guide member 426, e.g. a ring-shaped guide member, attached to a surface of the centre section. The drive pipe support may be a loose fit allow some horizontal motion of the conductor pipe or a tight fit. In some embodiments, the hole in the centre section may be large enough to allow the flange 425 to pass through. Afterwards, a flange or other guide member 426 may be secured matching the diameter of the conductor pipe. In some embodiments, the centre section 218 may be constructed with a hole, such as an elongated slot, that is open towards the edge of the frame. The centre section may thus be fitted to the conductor pipe even at later stage and guides 426 may then be fit on top of the centre section.

FIGS. 5(A)-5(D), FIG. 6(A), FIG. 6(B), and FIGS. 8(A)-8(F) illustrate different embodiments of a method for installing a conductor pipe support system.

Figure 5B:
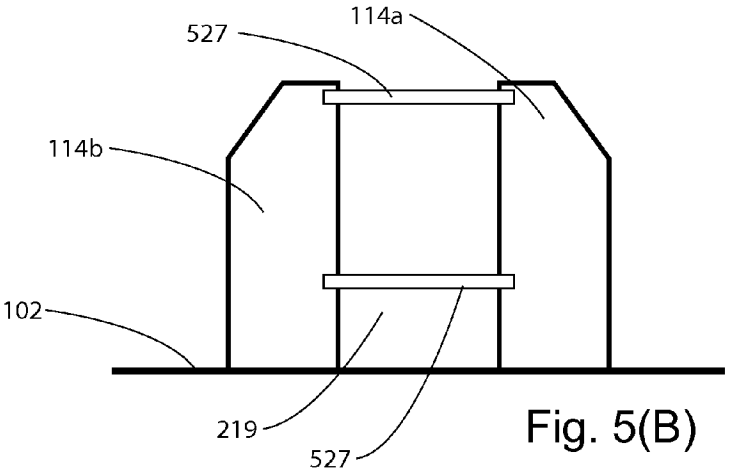
Figure 5D:
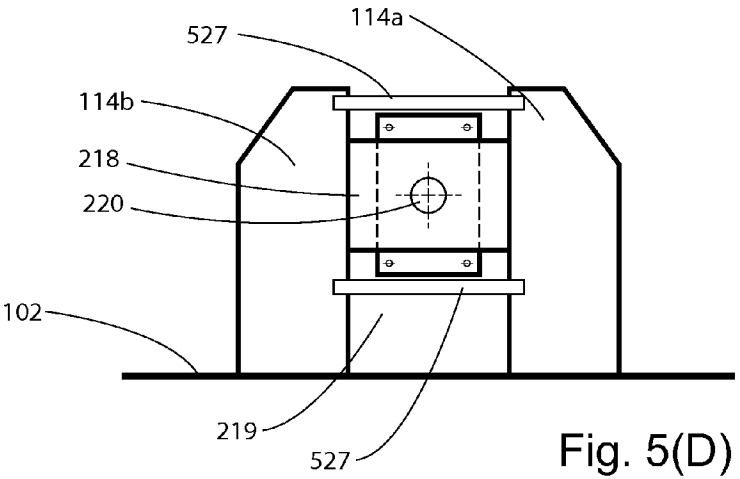
Figure 5A:
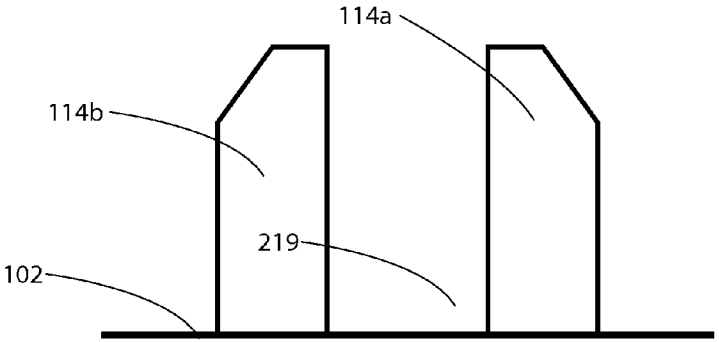
Figure 5C:
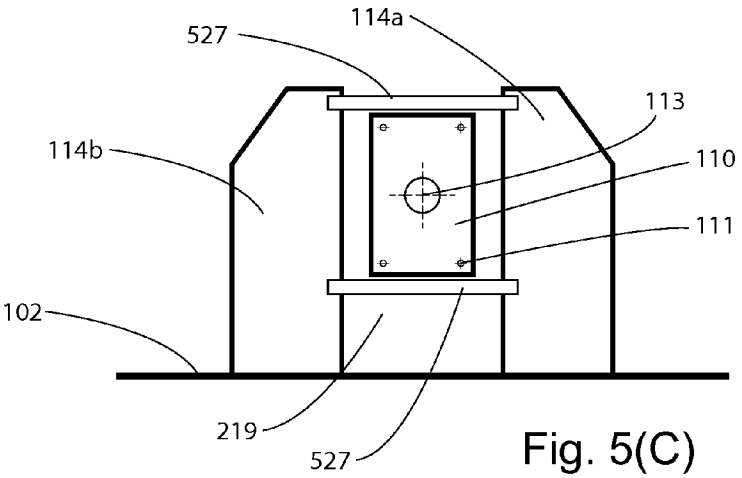

FIGS. 5(A)-5(D) illustrate various steps of an embodiment of a method for installing a conductor pipe support system. In an initial step, the access platform 114*a,b* is installed, e.g. lowered from an upright to a horizontal position. FIG. 5(A) shows a top view with the access platform after its installation. In a subsequent step temporary beams 527 or other support elements are installed which traverse the gap 219 between the platform sections, as illustrated in FIG. 5(B). Then the tension frame 110, with wires 111 attached to it, is lowered, e.g. using an on-deck crane. The tension frame is lowered through the gap 219 to its position below the platform 114*a,b* and the wires are connected to the traversing beams, as illustrated in FIG. 5(C). Alternatively, the tension frame 110 may be hooked up to the temporary beams 527 prior to lowering the assembly of the tension platform suspended from the beams until the beams rest on the platform 114*a,b*. Next, the centre section 218 is lowered by a crane and attached to the platform sections 114*a,b*. In a next step, the cantilever can be skid out and the tension frame may be hooked up to cylinders extending downward from the cantilever. To this end, the hydraulic cylinders may be stroked out, wires may be connected between respective padeyes or other connectors of the tensioning frame and the cylinders and, finally, the cylinders can be retracted to the position where they carry the frame.

Once the conductor pipe support system is installed, the conductor pipe may be lowered by the hoisting system and suspended in the tension frame, and the BOP stack may be installed.

FIGS. 6(A)-5(B) illustrate an alternative embodiment of a method for installing a conductor pipe support system. In this embodiment, the tension frame 110 and the centre section 218 are initially hooked up to each other such that they may be lowered as an assembly with the tension frame being suspended from and below the centre piece, e.g. by means of wires 628, beams or the like. The assembly may then be lowered into position by a crane and the centre section is attached to the access platform. The lowering may be performed by a crane. In any event, once the cantilever is slid into place, the tension frame may be hooked up to the cantilever as described above.

Figure 7:
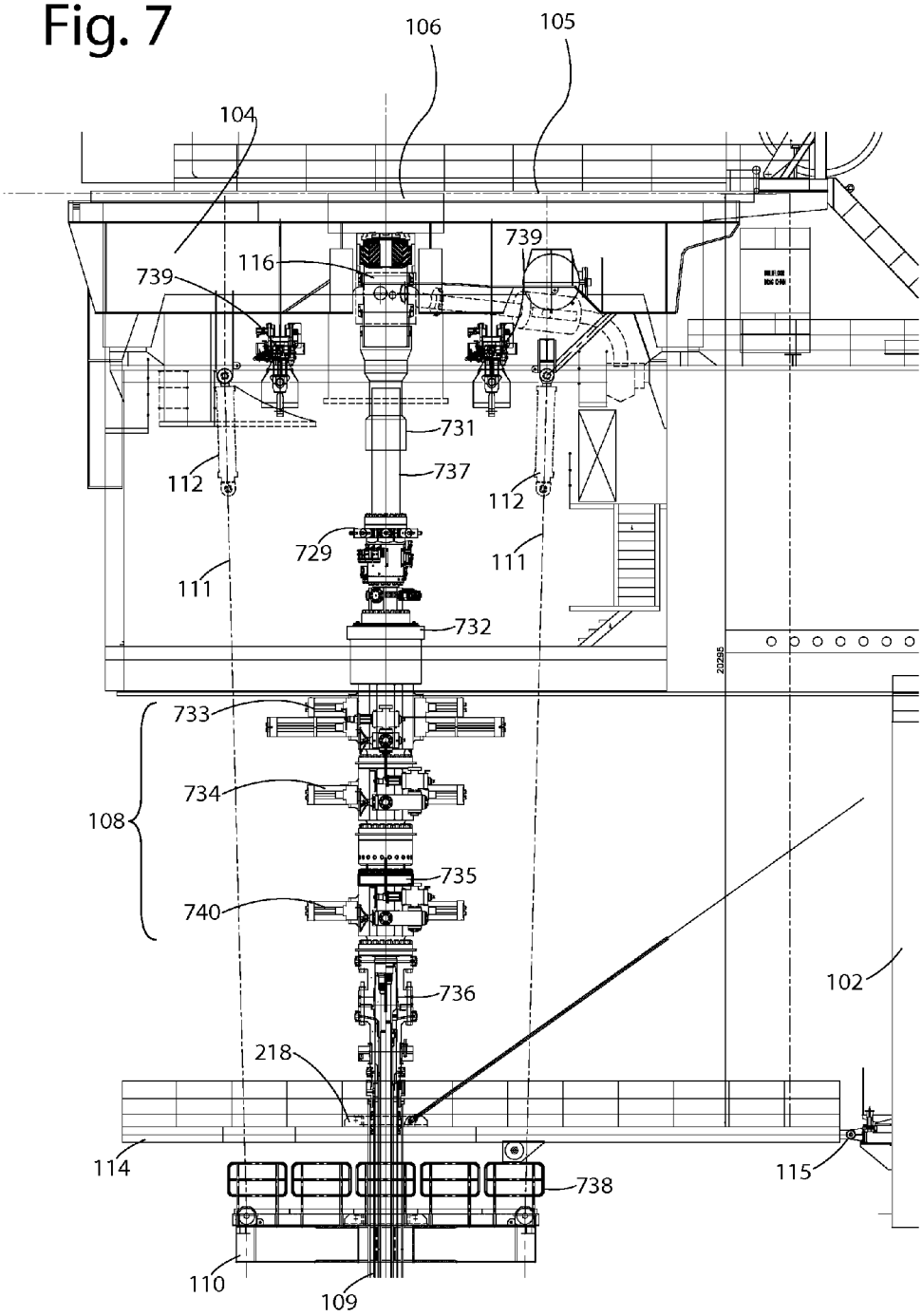
FIG. 7 schematically illustrates an example of a BOP stack and conductor pipe support system for a jack-up drilling rig.

FIG. 7 schematically illustrates an example of a BOP stack and conductor pipe support system for a jack-up drilling rig, e.g. the jack-up rig of FIG. 1. In particular, FIG. 7 shows the drill floor 106 supported by a drill floor beam of a cantilever 104 and comprising a rotary table 106. Below the rotary table a diverter system 116 is installed. Below the diverter system, a pressure control device 729 is provided separated from the diverter system by a telescopic part 737, an x-over 730 and an overshot mandrel 731. Below the pressure control device, the BOP stack 108 is provided which in this example comprises an annular BOP 732, a double BOP ram 733, a single BOP ram 734, an NT-2 quick connector 735, another single BOP ram 740, and a wellhead device 736. Below the wellhead device, the conductor pipe 109 extends downward horizontally supported by the venter piece 218 attached to the access platform 114 and vertically supported by a tension frame 110 located below the access platform 114, as described herein. The tension frame 110 is suspended from the cantilever by wires 111 and tension cylinders 112 as described herein. The tension frame 110 is provided with hand rails 738. The access platform 114 is connected to the outer hull 102 of the rig via hinges 115 as described above. FIG. 7 further shows BOP cranes 739 which are used during the installation of the BOP stack and may be used during installation of the conductor pipe support system as described above.

Figures 8A, 8B, 8C, 8D, 8E, 8F:
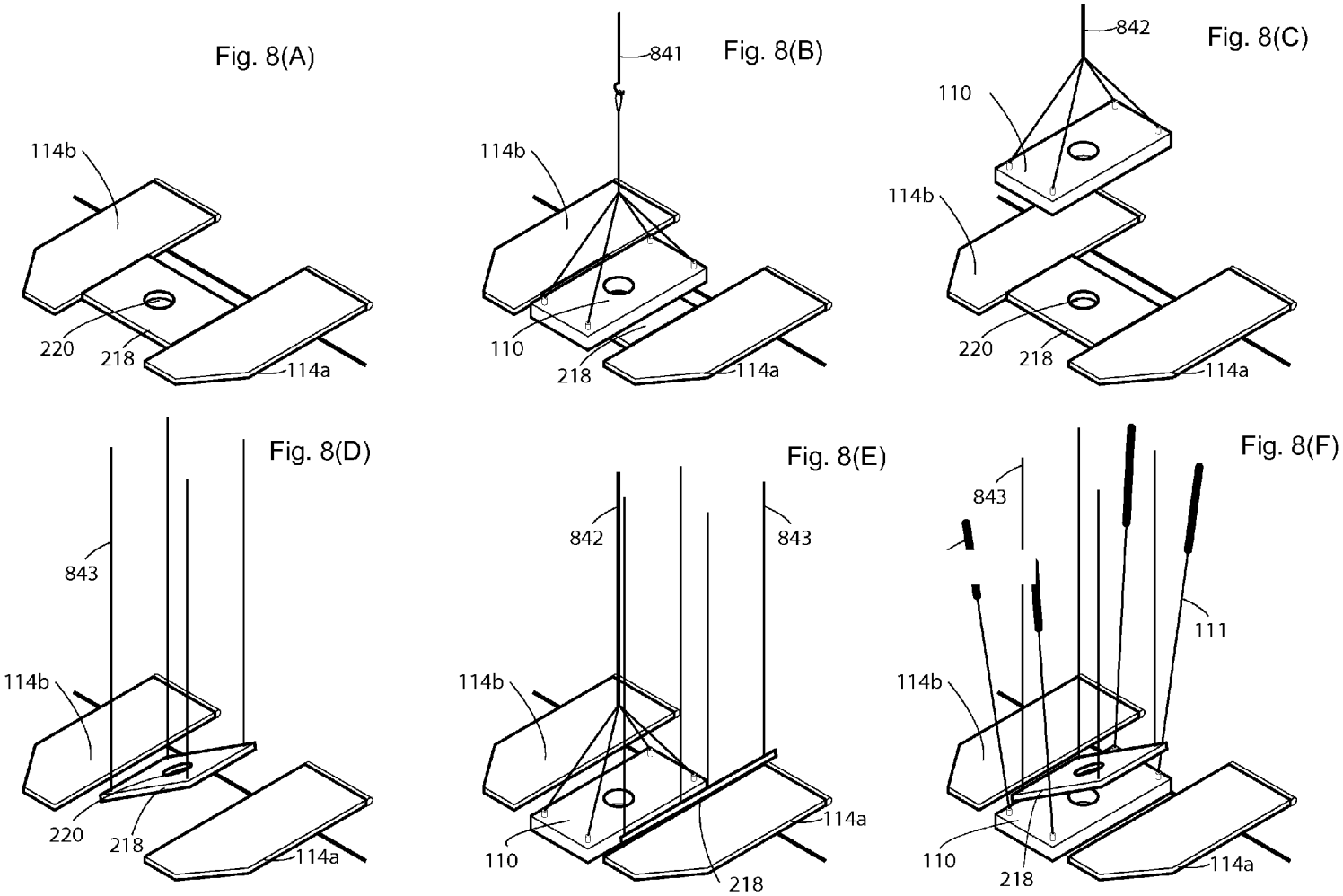

FIGS. 8(A)-8(F) illustrate yet an alternative embodiment of a method for installing a conductor pipe support system. In this embodiment, the centre section 218 is initially lowered on top of the access platform 114*a,b*, as illustrated in FIG. 8(A). Subsequently, the tension frame 110 is lifted over and positioned on top of the centre section 218, as illustrated in FIG. 8(B). This may be done by means of a deck crane as illustrated by wire 841. Once the cantilever is skid out, the tension frame 110 is lifted up again by means of the hoisting system lowering and lifting drill pipe 842 from which the tension frame is suspended, as illustrated in FIG. 8(C). Subsequently, the centre piece is flipped out of the way by means of the BOP cranes as shown in FIG. 8(D) and illustrated by BOP crane wires 843. Subsequently, the tension frame is lowered below the access platform and hooked up to the wires 111 and cylinders 112 of the tension system, as illustrated in FIG. 8(E). Finally, the centre section 218 is flipped back and installed on the access platform, as illustrated in FIG. 8(F).

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

In device claims enumerating several features, several of these features can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A bottom-supported offshore drilling platform comprising:

a hull and one or more legs extendable from the hull downward towards the seabed of a body of water so as to elevate the hull above a surface of the body of water;

a cantilever comprising a drill floor and a well centre defined in the drill floor through which well centre drilling operations may be performed through a blow-out-preventer system located below the drill floor and through a conductor pipe extending from the blow-out-preventing system downwards towards the seabed;

a conductor pipe support system comprising:

a guide member configured for supporting the conductor pipe against horizontal movement when the conductor pipe extends from the blow-out preventer system downward towards the seabed;

a support member configured for vertically providing tension to the conductor pipe; and an access platform, extending from said hull lower than said cantilever, for allowing personnel to access at least a bottom portion of the blow-out preventer system;

wherein the support member is connectable to the conductor pipe below the access platform.

2. A bottom-supported offshore drilling platform according to claim 1; wherein the guide member is connectable to the access platform.

3. A bottom-supported offshore drilling platform according to claim 1; wherein the support member has a plurality of connectors, each of which is connected to respective suspension elements, and thereby each defining respective suspension points of the support member.

4. A bottom-supported offshore drilling platform according to claim 3, wherein at least two of the suspension points are spaced apart from each other along at least one direction by a distance larger than a horizontal size of the guide member so as to allow the suspension elements to pass on respective sides of the guide member.

5. A bottom-supported offshore drilling platform according to claim 1; wherein the access platform defines a gap through which the conductor pipe protects downwards, the gap having a periphery at least partially defined by the access platform.

6. A bottom-supported offshore drilling platform according to claim 5; wherein the guide member spans across the gap and is connected to the access platform on respective sides of the gap.

7. A bottom-supported offshore drilling platform according to claim 5; wherein the support member has a plurality of connectors for connecting respective suspension elements and defining respective suspension points of the support member; and wherein the suspension points are spaced apart by a distance smaller than a width of the gap so as to allow the suspension elements to extend upwards from the suspension points through the gap.

8. A bottom-supported offshore drilling platform according to claim 5; wherein the support member is sized and shaped so as to allow the support member to be lowered through the gap.

9. A bottom-supported offshore drilling platform according to claim 1; wherein the support member has a plurality of connectors for connecting respective suspension elements for suspending the support member underneath the cantilever wherein the suspension elements transfer at least a major part of a conductor tension load of the conductor pipe to the cantilever via respective load transfer points arranged above the access platform.

10. A bottom-supported offshore drilling rig according to claim 1; comprising a pressure management device located between the equipment between the blow-out-preventing system and the drill floor.

11. A bottom-supported offshore drilling platform according to claim 1; wherein the guide member is connected to the access platform.

12. A bottom-supported offshore drilling platform according to claim 1; wherein the blow-out-preventer system located at least partly below the cantilever.

13. A bottom-supported offshore drilling platform according to claim 1; wherein said tension is at least 100 tons.

14. A support member for a conductor pipe support system of a bottom-supported offshore drilling platform defined by claim 1; wherein the support member is configured for supporting at least a part of the load of a conductor pipe when the conductor pipe extends from a blow-out preventer located below a bottom-supported offshore drilling rig downward towards the seabed; wherein the support member defines an upper surface and has a hole through which the conductor pipe may extend downwards; and wherein the support member comprises a hand rail extending along a perimeter of said upper surface.

15. A method of installing a conductor pipe support system for a bottom supported offshore drilling platform, the bottom supported offshore drilling platform comprising a hull and one or more legs extendable from the hull downward towards the seabed of a body of water so as to elevate the hull above a surface of the body of water; a cantilever comprising a drill floor and a well centre defined in the drill floor though which well centre drilling operations may be performed through a blow-out-preventing system located below the cantilever and through a conductor pipe extending from the blow-out-preventer system downwards toward the seabed; the conductor pipe support system comprising:

a guide member configured for supporting the conductor pipe against horizontal movement when the conductor pipe extends from the blow-out preventer system downward towards the seabed;

a support member configured for vertically supporting at least a part of the load of the conductor pipe; and an access platform for allowing personnel to access at least a bottom portion of the blow-out preventer system;

wherein the method comprises connecting the support member to the conductor pipe below the access platform.

16. A method according to claim 15; comprising attaching the guide member to the access platform while the support member is suspended below the guide member.

17. A method according to claim 15; further comprising installing the blow-out-preventing system and pressure management equipment between the access platform and the drill floor.

* * * * *